United States Patent [19]

Epper et al.

[11] Patent Number: 4,617,010

[45] Date of Patent: Oct. 14, 1986

[54] APPARATUS FOR THE PARTIAL DEHYDRATION OF SLUDGE IN THE CENTRIFUGE FIELD OF A SOLID JACKET CENTRIFUGE

[75] Inventors: Wolfgang Epper, Bergheim; Johannes Florenz, Monchen-Gladbach, both of Fed. Rep. of Germany

[73] Assignee: Klöckner-Humboldt-Deutz AG, Fed. Rep. of Germany

[21] Appl. No.: 614,106

[22] Filed: May 24, 1984

[30] Foreign Application Priority Data

May 24, 1983 [DE] Fed. Rep. of Germany ..... 3318793

[51] Int. Cl.[4] ..... B04B 3/00; B04B 11/00

[52] U.S. Cl. ..... 494/52; 494/44; 494/55; 494/56

[58] Field of Search ..... 366/78, 303, 309, 319, 366/324; 494/30, 32, 33, 34, 35, 44, 52, 53, 54, 55, 56, 58, 66

[56] References Cited

U.S. PATENT DOCUMENTS

| | | | |
|---|---|---|---|
| 2,184,598 | 12/1939 | Jahn | 49/44 |
| 2,528,974 | 11/1950 | Ritsch | 494/35 |
| 2,837,272 | 6/1958 | Laguilharre | 494/53 |
| 3,393,899 | 7/1968 | Wells | 366/324 |
| 4,154,798 | 5/1979 | Bittner | 366/303 |
| 4,176,966 | 12/1979 | Borneman | 366/78 |
| 4,209,128 | 6/1980 | Lyons | 494/53 |
| 4,213,710 | 7/1980 | Hold | 366/319 |
| 4,381,849 | 5/1983 | Conant | 494/53 |

FOREIGN PATENT DOCUMENTS

| | | | |
|---|---|---|---|
| 2103502 | 2/1983 | United Kingdom | 494/53 |

*Primary Examiner*—Robert W. Jenkins

*Attorney, Agent, or Firm*—Hill, Van Santen, Steadman & Simpson

[57] ABSTRACT

An apparatus for partial dehydration of a sludge in the centrifugal field of a centrifuge wherein the residual moisture of the sludge is substantially reduced with a comparatively low compression of the sludge, and the non-effective cone length of the centrifuge is reduced without shortening the sludge dwell time. The invention includes an arrangement of agitator elements within the centrifugal drum, coupled with a following shearing centrifuge and decanter, the shearing centrifuge being connected at the discharge of the centrifugal drum.

14 Claims, 22 Drawing Figures

APPARATUS FOR THE PARTIAL DEHYDRATION OF SLUDGE IN THE CENTRIFUGE FIELD OF A SOLID JACKET CENTRIFUGE

BACKGROUND OF THE INVENTION

1. Field of the Invention

The present invention is in the field of removing moisture from sludge in the centrifugal field of a solid jacket centrifuge through the use of agitator elements and a shearing centrifuge.

2. Description of the Prior Art

In the dehydration of sludge, particularly of finely dispersed sludges, which occur in decanting centrifuges through sedimentation from a suspension, it has been observed that the residual moisture is lower in the case of greater radial acceleration, the lower the difference in rotational speed between the exterior rotor and an interior rotor with a helical conveyor, and the greater the solid matter throughput. Using all the cited variables, and taking into account the above-identified relation, a so-called compression number or coefficient can be determined. In specific ranges of the compression number, the residual moisture continuously decreases. Beyond that range, however, as the compression number increases, the residual moisture content is not significantly changed. In other words, beyond a specific limit of compression coefficient, no further reduction of residual moisture can be obtained.

This can be explained in that in the case of the boundary residual moisture, all particles have solid contact in relation to one another and thus the lowest possible packing density has been achieved. This theoretically possible value of boundary residual humidity, however, is far below those values which can be obtained in apparatus currently being used as sedimentation centrifuges. At least it has not been possible to the present time in the case of large technical apparatus to obtain the above-explained boundary residual moisture.

SUMMARY OF THE INVENTION

The present invention provides an apparatus for the dehydration of sludge in the centrifugal field of a solid jacket centrifuge by means of which the residual moisture of the sludge is greatly reduced with a comparatively low expense even in the case of comparatively low compression of the sludge.

In order to achieve this objective, the present invention provides a rotating solid jacket cylinder into which the sludge is charged, in combination with agitator elements which are arranged to function as vibrator or agitator members executing a relative movement in relation to the sludge through which, independently of the transporting effect, mechanical kinetic energy is introduced in the sludge.

According to the fundamental idea of the present invention, a dewatering effect is substantially achieved by virtue of the fact that the compressible sludges can be brought to a particularly low residual moisture content by being exposed to mechanical stresses in the centrifuge which lead to local compresssions and the formation of shearing joints or seams through which liquid can drain off radially toward the interior.

It is preferred that periodic mechanical stresses be produced in the sludge, for example, by agitator elements which are designed in the form of vibrators. On the surface of such a vibrator which provides oscillating movements within the sludge, local mechanical stresses are brought about in the form of compressions or concentrations which release liquid which flows radially inwardly toward suitable channels, so that the drain channels for the liquid either run along the agitator elements or can be formed by themselves.

In an alternative form of the present invention, there can be provided agitator elements which are designed in the form of members rotatably arranged and capable of being driven with a rotational speed which is different compared to that of the cylinder. It is preferred in this instance that the rotational speed difference between the cylinder and the agitator members be adjustable and that it can be controlled in a specific fashion.

A further design of the subject matter of the present invention provides agitator members which are in the form of blades or fins whose angle of pitch is adjustable.

Good results can also be obtained by virtue of the fact that through the use of the agitating members, the sludge is capable of being charged alternately by means of a reciprocating movement in the circumferential direction or in an axial direction.

In a particularly preferred form of the invention, the agitator members are so designed that with the introduction of mechanical energy and the related shearing effect, a simultaneous transport effect in a specific direction is provided.

The desired dewatering of the sludge can also be accomplished by means of agitator members which are arranged to move back and forth in a direction parallel to the rotational axis of the drum. To compensate for the nature of the product being processed, the lifting, the speed, and/or the angle of pitch of the agitator members in the form of agitator surfaces can be made adjustable. Instead of a rotational movement or instead of a reciprocating movement, it is also within the scope of the invention to provide an arrangement in such a manner that the agitator members will execute a tumbling movement of the sludge within the drum.

In accordance with the present invention, a preferred form of apparatus takes up the thickened sludge from, for example, an underflow of a thickener or from a normal decanter and carries out a particularly good dewatering as the last treatment step. Thus, there can be provided agitator members which are arranged in a dehydration apparatus which is connected beyond the conventional sludge treatment machine.

The inventive application of mechanical energy to the sludge can also be carried out in a subsequently connected apparatus in an existing centrifuge or it can be built into a centrifuge, particularly in conjunction with the decanter. Thus, a further preferred form of the invention provides agitator members which are arranged in at least one dehydration stage within a conventional centrifuge such as a decanter centrifuge. Preferably, the arrangement is such that the agitator members are arranged in the area of transition from the cylindrical portion of the apparatus to the cone.

In the use of the arrangement of the present invention in a decanting centrifuge, the agitator members can be arranged in a conventional decanter centrifuge in the area of the helical screw so that in addition to the transport effect on the sludge, there is simultaneously a shearing effect brought about. In this embodiment, it is important that the agitator members be located between the blades of the helical screw. In an alternative form of this variant, the agitator members may consist of parts of the helical screw which through proper shaping exercise a shearing effect on the sludge.

It is also possible to obtain the desired increased shearing of the sludge by employing radial slits in the exterior circumferential region of the helical screw. In this manner, a portion of the sludge will flow back through the radial slits.

In order to improve the transport effect, another embodiment of the invention makes use of blades which have surface areas between the slits offset from each other so that an arrangement resembling vanes in a turbine is obtained.

In order to further increase the transport effect, there can be provided agitator members which project radially inwardly from the drum. A particularly high shearing effect is generated since the agitator members are designed in the form of guide plates or fins in the manner of a turbine blade arrangement. In order to deal optimally with different types of sludges, it is furthermore provided that the pitch angle of the guide plates or blades be adjustable.

A particularly strong shearing effect results in the case of an arrangement wherein the agitator members are designed in the form of rotors which move axially back and forth, geared with one another in a comb-like fashion.

Small residual moisture contents can be obtained in the case of the apparatus of the present invention by a back and forth movement of the agitator elements independently of whether the movement proceeds basically in a rotary or translatory manner.

The advantages of the present invention which secure a particularly good dewatering of the sludge do not make it absolutely necessary to operate the apparatus continuously. A charge-wise operation has many advantages. A higher torque results in the case of a greater thickening of the sludge and toward the end of the processing of a charge, the rotational speed can be reduced. In the case of a very low rotational speed of the exterior rotor or even in the case that it is standing still, the thickened sludge can be discharged. It is also possible to save energy with a low drum rotational speed, to fill in sludge, and then drive up the apparatus to high rotational speeds and dewater at a high rotational speed. When the torque during the operation of the apparatus is measured, on the basis of increased current intake of the drive motor, the consistency of the sludge and the already attained dehydration can be measured. If the blades for the agitator members which are designed in the form of guide plates are employed in the manner of turbine blades, the sludge can be discharged at a very low rotational speed.

In a typical installation, a cylindrical solid jacket drum is partially equipped with agitator elements in the form of shearing blades on the screw conveyor and the drum. The inflow is arranged at the rear side of the drum. The dewatered sludge is transported forwardly into the free section of the drum and from there it is discharged by means of a scraping installation in a manner similar to a peeling centrifuge. The liquid escaping upwardly is drawn off by means of a liquid separation tube.

The machine can also be designed to provide a longer cylindrical solid jacket drum which is driven axially back and forth by a shearing helical conveyor which is relatively short in its axial direction, whereby the shearing helical conveyor naturally rotates relative to the drum.

BRIEF DESCRIPTION OF THE DRAWINGS

A further description of the present invention will be made in conjunction with the attached sheets of drawings in which.

DESCRIPTION OF THE PREFERRED EMBODIMENTS

All known decanters are driven with a relatively high pool depth. This is necessary in order to avoid turbulences, or dragging effects on the flow and not to disturb the clarification or settlement of the solid particles. This high level, however, has the disadvantage that the settled sludge must be transported upwardly over a high embankment. However, because the cone angle in the case of sludges cannot be made high because otherwise it will slide back in the spiral direction or beneath the helical blade tips, the cone as a result becomes very long. This unnecessarily long cone length in relation to the overall length of the rotor occupies a large proportion, usually between 40 to 60% of the cone length.

There are two possibilities to remedy these defects. The sludge transport by means of the cone must be improved. This leads to the construction of square-threaded helical worms in the cone section. It is then necessary, prior to the initial charging of the decanter, to introduce a sand suspension into the decanter. The crevice between the blades of the helical conveyor and the drum interior wall in the conical section is thereby sealed. Consequently, the sludge can then only slide back in the spiral direction.

An additional remedy consists in not transporting the sludge upwardly to the cone at all but to transport it through the jacket into the housing by means of calibrated jets in proximity of the transition between the cylinder and the cone. However, a precaution must be taken to insure that only the amount of arriving sludge is being discharged, and that water standing thereabove does not break through. Such jet decanters have a substantially shorter sludge dwell time than other decanters with cones and therefore their residual moisture contents will always be higher.

With the elimination of the cone, a large portion of the rotor length would be available for improving the clarification. These were the inventive considerations which led to the present invention so that the extension of the clarifying cylindrical portion recovers more clarifying area. Thus, according to Stokes' Law, the throughput of the decanter is increased in a linear fashion.

With a longer available clarification area, however, even in the case of using a helical conveyor divering in the liquid direction, a larger channel width can be obtained, and the throughput can be increased.

Figure 1:
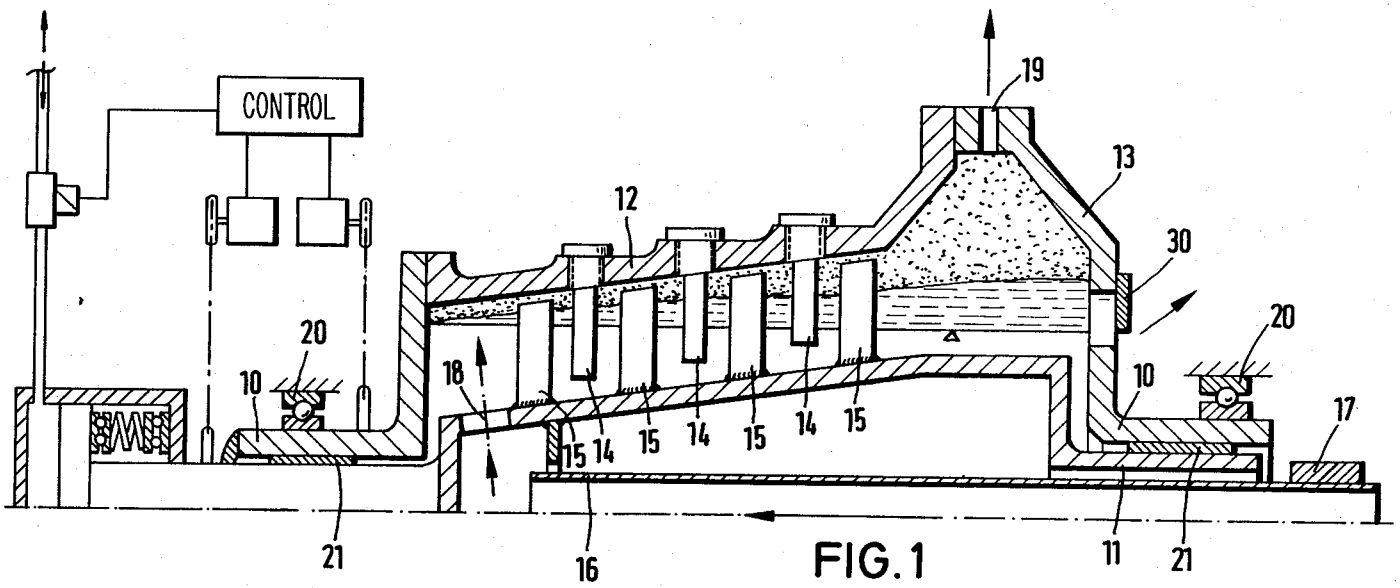
FIG. 1 is a schematic longitudinal section of a sludge dewatering apparatus according to the present invention.

Turning now to the drawings, in the illustration of FIG. 1 there is shown an exterior rotor 10 which is arranged to be rotatably mounted on both sides in roller bearings 20. The exterior rotor 10 includes a solid jacket cylinder 12 which has a comparatively flat conical design. Subsequent to this section, on the side where the cone opens, there is a deep conical part 13. This deep conical part 13 can be also in the form of a double cone which essentially forms an annular space extending further radially toward the exterior than the interior space of the exterior rotor 10. Within the exterior rotor 10 there is an interior rotor 11 concentrically mounted for rotation with respect thereto. The interior rotor in FIG. 1 is shown rotatably mounted by means of friction bearings 21 on both sides along the shaft of the exterior rotor 10. Both the exterior rotor 10 as well as the interior rotor 11 support turbine blade type guide plates 14 and 15, respectively, which act on the sludge as agitator elements. The guide plates 14 are screwed into the exterior rotor 10 from the exterior side and are preferably adjustable in their pitch angle. The guide plates 15 on the interior rotor 11 are welded to the surface of the interior rotor 11.

As shown in FIG. 1, the interior rotor may have a shaft extension 1 extending therefrom, with a piston 2 located at its outer end. The piston 2 is displaceable in a cylinder 3. A conduit 4 communicates with the cylinder 3 and supplies a hydraulic fluid or compressed air in pulsating fashion against the piston 2 during operation of the centrifuge. At the back side of the piston 2 there is a spring 5 positioned between axial bearings 6, the spring 5 serving to return the piston 2 to its initial position after the piston has been displaced by the pressurized fluid.

The exterior rotor 10 has a sprocket 101 attached thereto which is driven by a chain 102 from a motor 103. In a similar manner, a sprocket 104 engages a chain 105 driven by a motor 106. The speeds of motors 103 and 106 are controlled by means of a control unit 107. The control unit 107 controls the hydraulic fluid flow in the conduit 4 by means of a control line 108 which energizes a solenoid actuated valve 109, thereby controlling the stroke of the reciprocatory motion of the rotors relative to each other.

The angle of incidence of the guide plates 14 is adjustable from the exterior as indicated by the arrows 7.

A pre-thickened sludge is introduced by means of a pump through a stationary inlet pipe 16 which is mounted in a shim 17 connected with the machine frame into the interior space of the machine. The sludge enters through an opening 18 into an intermediate space between the interior rotor 11 and the exterior rotor 10. The two rotors rotate with a different rotational speed which can be generated by a planetary gearing.

Since the agitator elements which may be in the form of guide plates, blades, or bolts are interdigitated from the exterior and interior in a comb-like fashion, the sludge is sheared between the two sets of agitator elements. Liquid is thus separated off which, because of its lower specific gravity, has a tendency to flow radially inwardly. The liquid separated from the sludge forms a liquid layer on the radial interior side of the sludge whose interior diameter can be adjusted by means of an annular diaphragm or baffle plate 30.

The sludge is transported by means of centrifugal force to the opened end of the comb and enters the deep-conical section 13. The sludge transport can be accelerated or delayed through a suitable selection in the arrangement and shape of the guide plates 14 and 15.

At the rotating edge of the double comb which forms the deep-conical section 13 of the exterior rotor 10, the greatly thickened sludge is discharged either continuously by means of a plurality of jets 19 or intermittently by means of a controlled circular slide as known to the prior art.

The guide plates 15 in the interior rotor 11 can also extend into the double cone space and project into the sludge.

In order to prevent a complete escape of the thickened sludge through the jets 19, there are known methods for the measurement of the sludge level, which can be employed. The path of the sludge through the apparatus is basically indicated by the arrows illustrated in FIG. 1, starting with the inlet pipe 16, through the opening 18, obliquely toward the upper left portion, and exiting through the jet 19 upwardly.

The liquid which has collected radially within the sludge discharges as shown by an arrow pointing to the upper right by means of the diaphragm or baffle plate 30.

Figure 2:
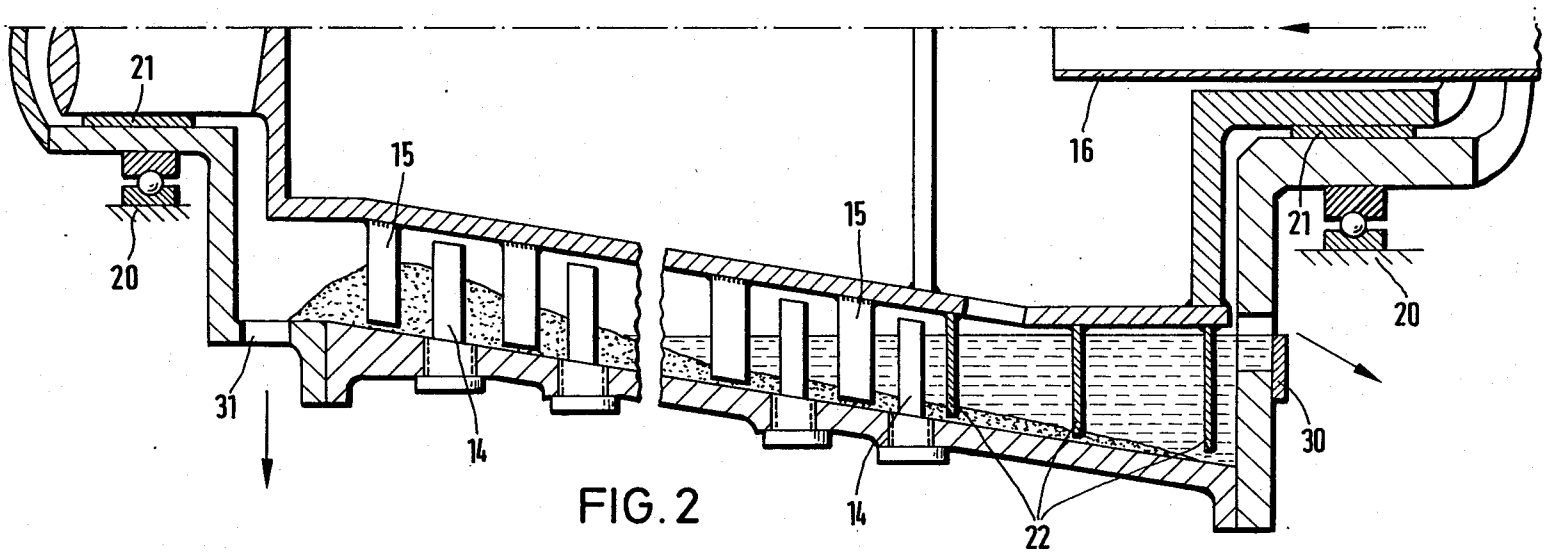
FIG. 2 is a longitudinal section of an alternative embodiment of a sludge dewatering apparatus.

If the discharge through jets is to be avoided and the sheared sludge has assumed a sufficiently high consistency, there are forms of the invention available in which the sludge is transported upwardly through corresponding guide plates 14 and 15 along the cone. Such an arrangement is shown in FIG. 2 in a schematic longitudinal section. FIG. 2 illustrates a purely conical countercurrent machine in which, on the side in which the liquid exits, an additional one or more turns of a normal helical screw are arranged. The screw blades are designated in FIG. 2 at reference numeral 22. It is pointed out that in FIG. 2, the same reference numerals are employed as in FIG. 1 for components which correspond to similar components in FIG. 1.

Analogous to known decanters which can also be designed in the form of concurrent flow machines, in the case of the apparatus illustrated in FIG. 2, the sludge which is pre-thickened, can also be supplied to the machine on the side opposite the solid material discharge. The sludge thus follows the path which is illustrated by the arrow pointing to the left in the inlet pipe 16 and by the arrow pointing downwardly beneath a discharge opening 31. The liquid separated from the sludge according to the present invention is drawn off by means of a diaphragm or baffle plate 30 as shown by the arrow pointing downwardly to the right.

The guide plates 14 which are screwed into the exterior rotor 10 can be adjusted from the exterior in their angle of pitch relative to the surface line of the cone. The guide plates 15 which are mounted on the interior rotor 10 can either be rigidly welded thereto or made rotatable in such a fashion that their angle of pitch can also be adjusted. The sludge to be dehydrated enters through a stationary inlet pipe 16 into the interior rotor 11 and through the latter by means of opening 18 passes into the separating chamber which exists between the interior rotor 11 and the exterior rotor 10. The interior rotor 11 is rotatably mounted within the hollow shaft of the exterior rotor 10 by means of friction bearings 21.

Figure 3:
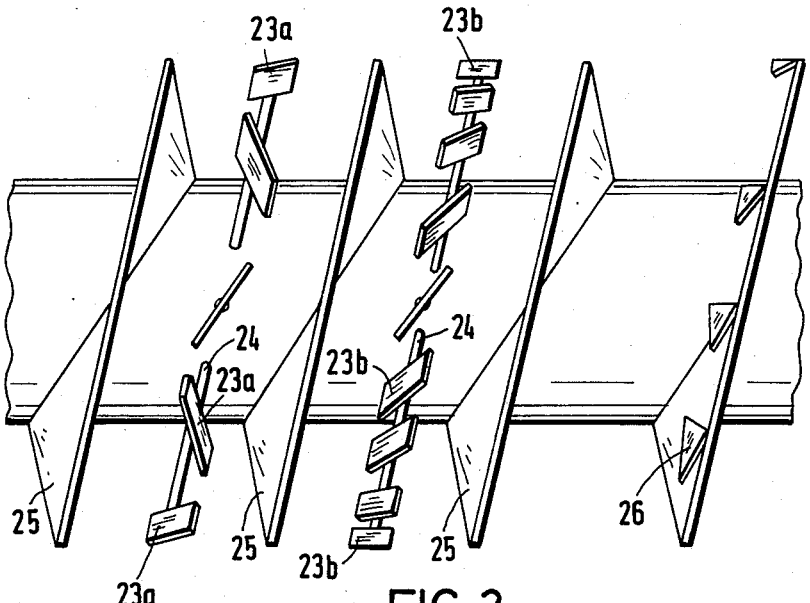
FIG. 3 illustrates sample embodiments of agitator elements which can be arranged between the blades of a helical conveyor.
Figure 4:
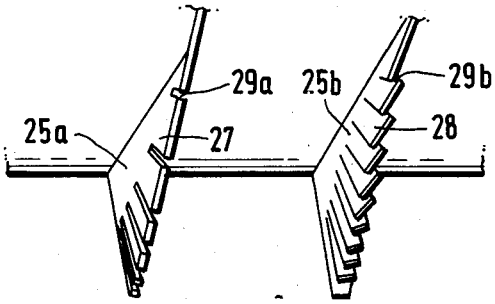
FIG. 4 illustrates a modified conveyor in which the blades exhibit agitator elements in their exterior peripheral region.

An alternative embodiment of the agitator elements of the present invention is illustrated in FIGS. 3 and 4. This embodiment provides a conventional decanter which can operate as a countercurrent decanter or also as a concurrent decanter and can be constructed or modified through structural changes such that in additional to transporting the sludge through the helical conveyor, an additional mechanical influence is exerted on the sludge through special constructions such as those illustrated schematically in FIG. 3. As illustrated, between the helical blades 25 there are shearing vanes 23*a* and 23*b*, respectively, attached to radial bolts 24. The shearing vanes 23*a* transport the sludge back and forth in an alternating fashion whereas the shearing vanes 23*b* transport the sludge in one direction. Also, tabs 26 applied to helical blades 25, such as are illustrated in the right-hand portion of FIG. 3 also have the above described shearing effect.

The mechanical stressing of the sludge which is characteristic of the present invention, particularly through shearing, can also be brought about in that the helical conveyor is interrupted in the region of its exterior periphery. In FIG. 4 there is shown, in the left portion, a vane 25*a* which has radial notches or slits 29*a*. Between the slits agitator blades 27 act in a fashion such that the sludge is pressed back through the slits 29*a*. In this manner, by means of an intentional shearing effect, the sludge is mechanically acted upon in such a fashion that the dewatering desired in accordance with the present invention is obtained.

In order to achieve an improved transport effect, the regions between the slits 29*b* can be bent in such a fashion that dihedral or angularly offset, overlapping agitator blades 28 result. A turbine blade type arrangement is thereby provided in the exterior peripheral region of the blade 25*b*.

Figure 5:
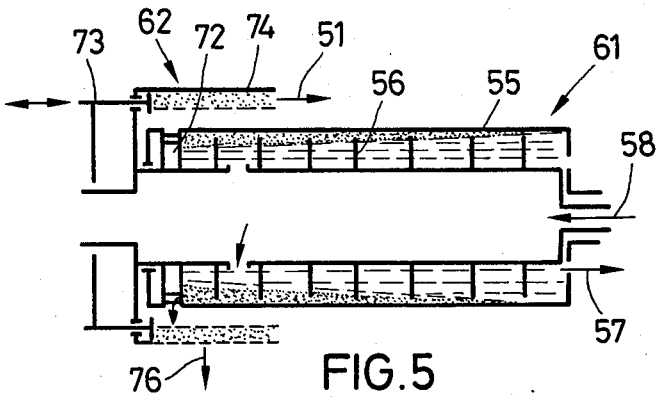
FIGS. 5, 6, 7, 9, 10, 13, 16 and 18 show various forms of apparatus employing a decanter over which a shearing device is positioned in a radial direction, the showing being in longitudinal section.

In FIG. 5, in longitudinal section, there is shown the combination of a cylindrical decanter 61 with a shearing unit. The helical blades 56 of the decanter 61 exhibit no increasing inclination. The outer shell of the device is designed as a cylinder. On the one side, there is an inflow 58 of the suspension, and an outflow 57 of the centrifuged product both of which are indicated by arrows. In the lower region, there is illustrated schematically a discharge 76 consisting of openings for discharging the shearing solid matter. Radially, the shearing installation is a self-contained unit. The sludge resulting from sedimentation is transported by means of a controlled sludge valve 72 into the exterior drum thrust shearing unit. The shearing is obtained by means of thrust rakes 73 which move axially back and forth, and the greatly dewatered sludge is discharged through a discharge 51. This version has the advantage that two functions are satisfied. The helical screw in the decanter 61 can operate with a differential rotational speed which is optimum for clarification. In addition, and independently of the decanter, the thrust frequency and the thrust length can be adjusted with settings which provide for extreme thickening.

Figure 6:
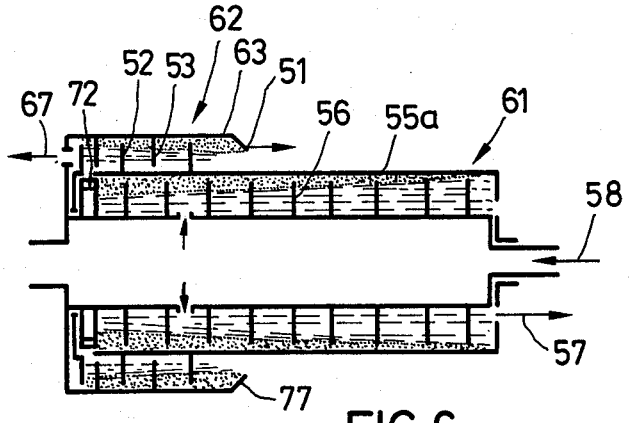

The decanter 61 shown in FIG. 6 is in the form of a countercurrent device. The shearing centrifuge 62 is slipped over the decanter 61. The centrifuged product is shown leaving by means of a line 67 and is returned to the inflow line 58. The sheared solid matter is eliminated through a discharge 77. By means of a sludge valve 72 it is possible to remove already pre-thickened sludge from the floor of the helical rotor 55*a*. A shearing rotor 63 and the helical rotor 55*a* are interconnected by means of a suitable drive (not shown) and therefore have the same differential rotational speed.

A high shearing speed is usually important for shearing. Through the use of the radial arrangement shown, this is achieved even in the case of smaller differential rotational speeds as are required for clarification.

Figure 7:
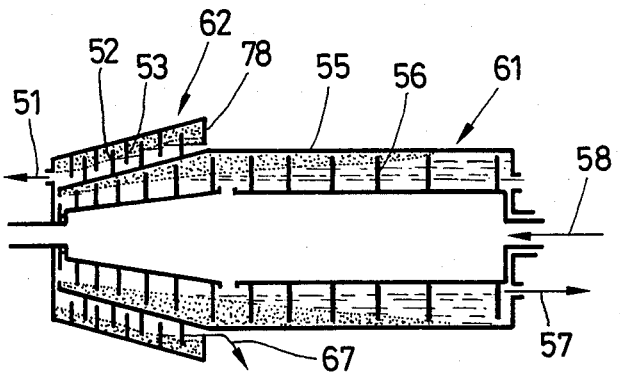

An additional slipped-on shearing centrifuge 62 is shown in FIG. 7. It includes a conically shaped solid jacket rotor. A discharge 51 for the sheared solid matter extends in the tapered portion of the shearing centrifuge 62. The product produced in the shearing centrifuge passes over a stop plate 78.

The thickened sludge issuing from the cylindrical-conical decanter 61 flows conically downward over the surface of the thickened, sheared cake and is transported upwardly in countercurrent relationship in the conical shearing drum. The decanter 61 is illustrated as a countercurrent decanter but a concurrent decanter can also be employed. In the lower region, the shearing centrifuged product is discharged through a discharge 67.

Figure 8:
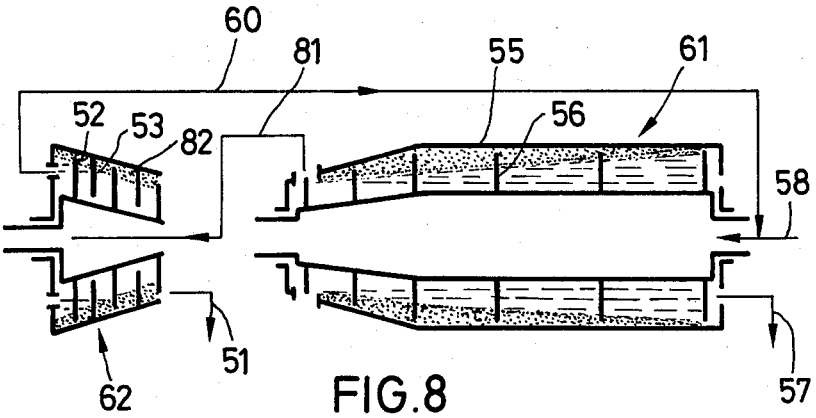
FIGS. 8, 12, 14 and 20 show an arrangement of decanter and of a shearing centrifuge in the axial direction.

In FIG. 8 the solid matter from the decanter 61 is supplied as indicated by the line 81 to the shearing centrifuge 62 which is axially spaced from the decanter 61. The shearing centrifuged product is conducted back into the inlet 58 of the decanter 61 by means of a return line 60. A countercurrent decanter or concurrent decanter can be used in this embodiment.

Figure 9:
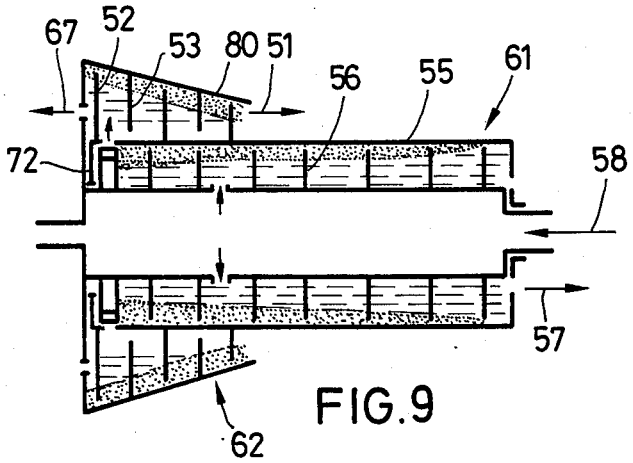

In FIG. 9 there is shown a cylindrical decanter with a jet opening and a slipped-over shearing rotor 80 of a conical construction. The larger radius of the conical shearing rotor 80 is in proximity to the sludge overflow in the region of the sludge valve 72. The shearing product flows out through openings indicated at the arrow 67 of the rear plate of the shearing centrifuge. The decanter helix and the jacket of the shearing centrifuge are arranged on the same shaft.

Figure 10:
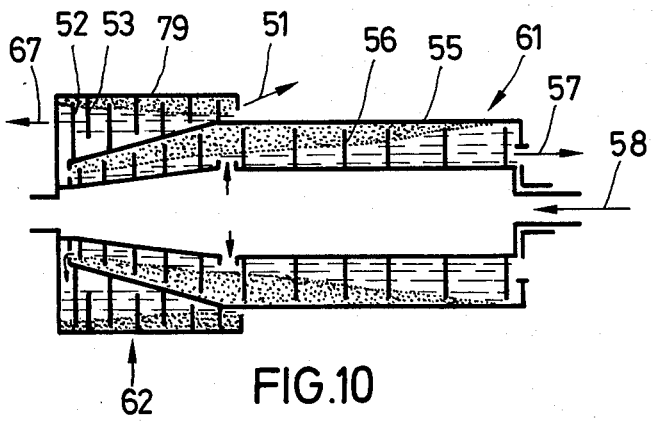

The embodiment shown in FIG. 10 is similar to that shown in FIG. 7 with a difference that the outside surface 79 of the shearing centrifuge 62 is likewise cylindrical. In this area, the outside surface of the decanter 61 is formed as a cone. The shearing members 52 are attached to the lateral area of the decanter 61 and the shearing members 53 are attached in the interior of the lateral surface 79 of the shearing centrifuge 62.

Figure 11:
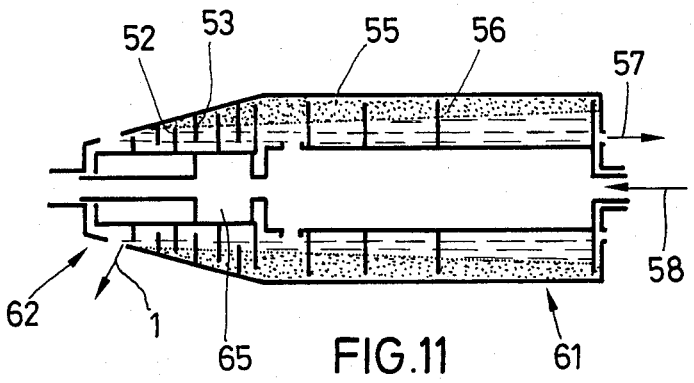
FIGS. 11, 15, 17, 19, 21 and 22 illustrate an arrangement of decanter and of a shearing centrifuge which are axially in the interior of a common solid jacket rotor, the showing being in longitudinal section.

Following the cylindrical decanter 61 there is a conically designed shearing centrifuge 62 in the illustration shown in FIG. 11. Both of the rotating members, the helical worm and the shearing rotor, are mounted in the interior of a common solid jacket rotor. However, they are operated at a different rotational speed. The helical blades are set in rotation by means of an externally disposed planetary gear while the drive 65 illustrated schematically in FIG. 11 is placed in the interior. Individual adjustment of the differential rotational speed is thereby made possible.

Figure 12:
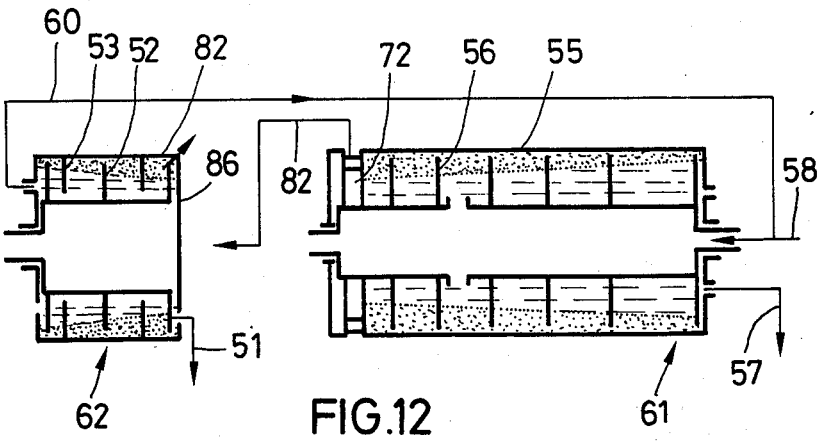

The apparatus shown in FIG. 12 corresponds generally to that of FIG. 8. The difference consists in that the decanter 61 and the shearing centrifuge 62 are both of cylindrical construction so that the lateral area 82 in the shearing centrifuge 62 is likewise cylindrical.

Figure 13:
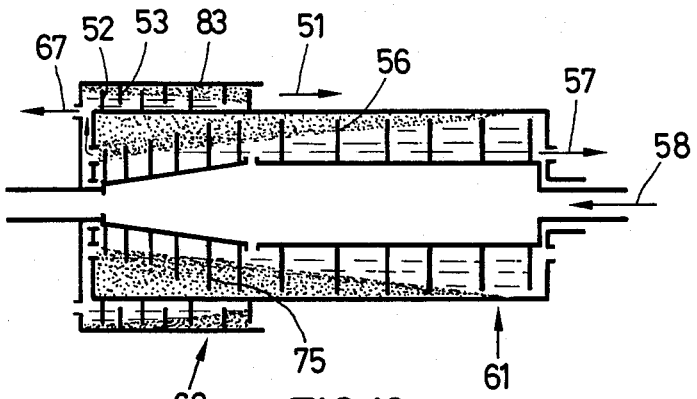

The decanter 61 shown in FIG. 13 does not employ any metallic cone. A purely cylindrical rotor is employed with which a cylindrical-conical helix is associated. The cone is formed by the sludge itself and solidifies with time. In this manner, there is no gap between the helix and the metal cone. Slipping back of the sludge is minimized. A countercurrent decanter or a concurrent decanter can be employed in this form. In this example, the shearing centrifuge 52 is slipped over the decanter 61.

Figure 14:
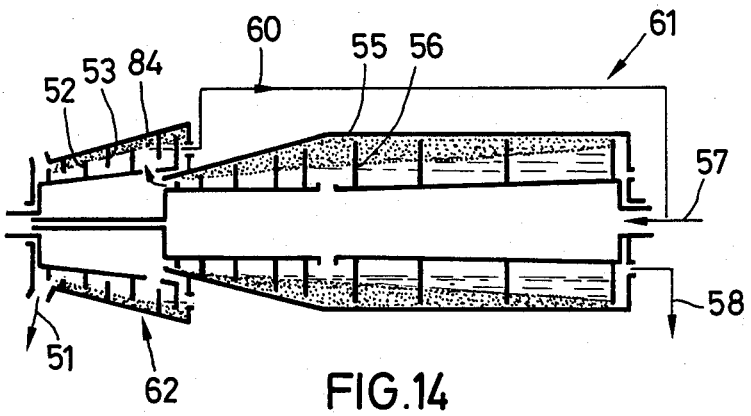

In FIG. 14 there is shown a cylindrical-conical decanter 61 which is axially rigidly connected with a shearing unit 62. While the two drums form a rigid unit, the helical conveyor of the decanter 61 and the shearing rotor are separately driven so that they can rotate with differential rotational speeds. On the left side, the shaft of the helical conveyor and that of the shearing rotor are separately conveyed. Each shaft is preferably provided with a separate planetary gear drive.

Figure 15:
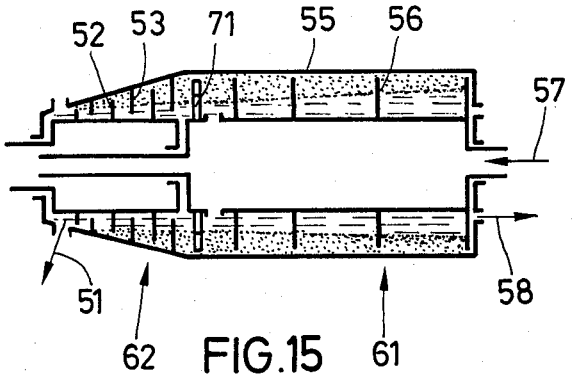

FIG. 15 shows in combination an axial construction between a cylindrical countercurrent decanter and a conical shearing rotor wherein the latter can be rotated with differential rotational speeds. An immersion disk or plate 71 insures that only thickened sludge can pass from the base of the decanter section into the shearing section. The shearing product flows directly back from the shearing section into the clarification section of the decanter (not illustrated).

Figure 16:
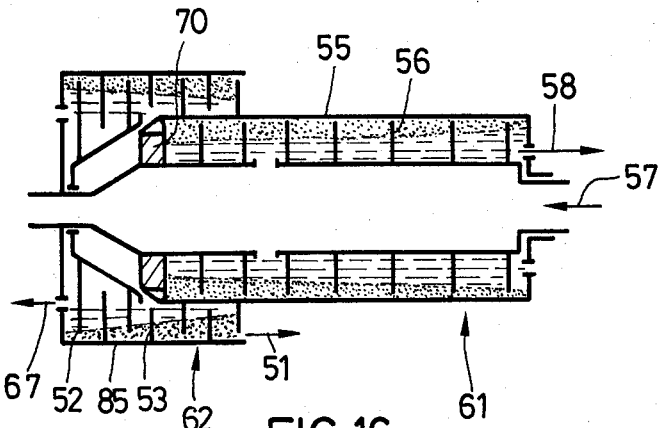

A cylindrical decanter 61 is combined in FIG. 16 with the cylindrical shearing centrifuge 62. The sludge discharged from jets in the jacket flows from the cylindrical drum into the superimposed shearing centrifuge 62. In this instance, concurrent and countercurrent decanters can be used. A stop plate 70 allows only the lower thickened sludge to enter the exterior drum.

Figure 17:
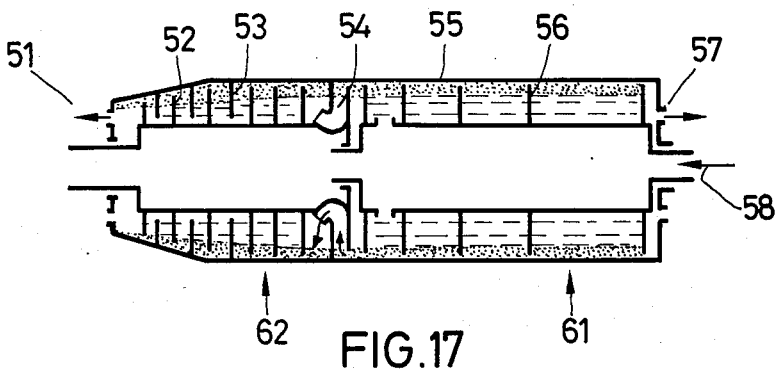

A purely cylindrical decanter centrifuge 61 is connected in series with a cylindrical-conical shearing centrifuge 62 in a common drum shown in FIG. 17. The interior members can rotate with different rotational speeds. The sludge is transported by means of a lifting pipe 54 from the base of the decanter centrifuge section into the shearing section. The decanter is shown in FIG. 17 as a countercurrent machine.

Figure 18:
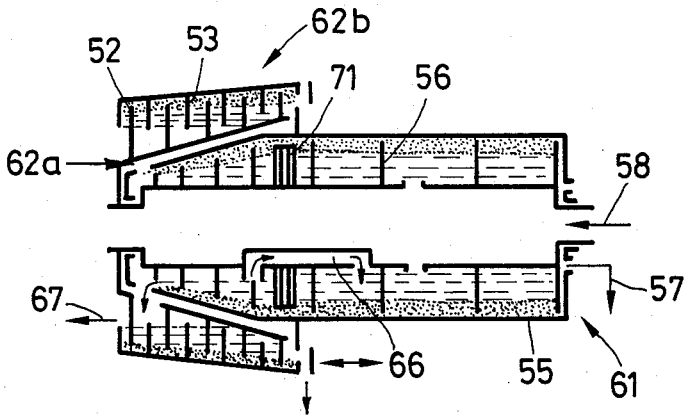

In FIG. 18, there are shown two shearing centrifuges 62*a* and 62*b* associated with the cylindrical decanter 61. The shearing centrifuge 62*a* is separated from the decanter by means of an immersion plate 71. Water being liberated is returned by means of a co-rotating overflow line 66. The discharged pre-sheared solid matter enters the external shearing drum 62. With this arrangement, a particularly intensive shearing effect is obtained. It is also of significance that the jacket of the decanter 61 is connected with the jacket of the shearing section and the helical conveyor of the decanter 61 is connected with the shearing rotor disposed on the exterior.

Figure 19:
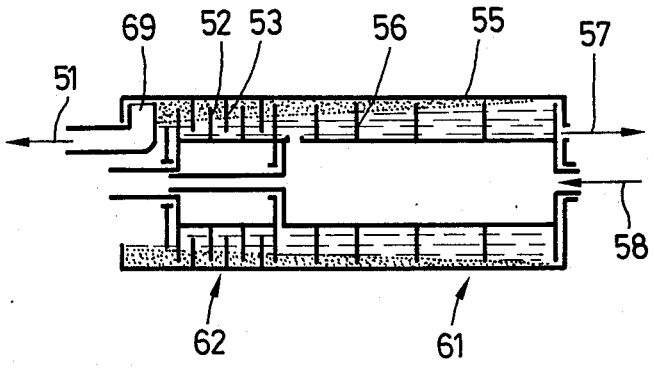

The decanter helix and the shearing rotor in the embodiment according to FIG. 19 can rotate with a differential rotational speed in relation to the jacket. The thickened solid matter is conveyed out of the rotor by means of a scraping device 69 which is preferably provided at the end of the shearing rotor. Concurrent types and countercurrent types can be employed as the decanter 61. The helical blades are here illustrated as diverging. The cylindrical decanter rotor and the cylindrical shearing rotor are assembled so as to be axially aligned.

Figure 20:
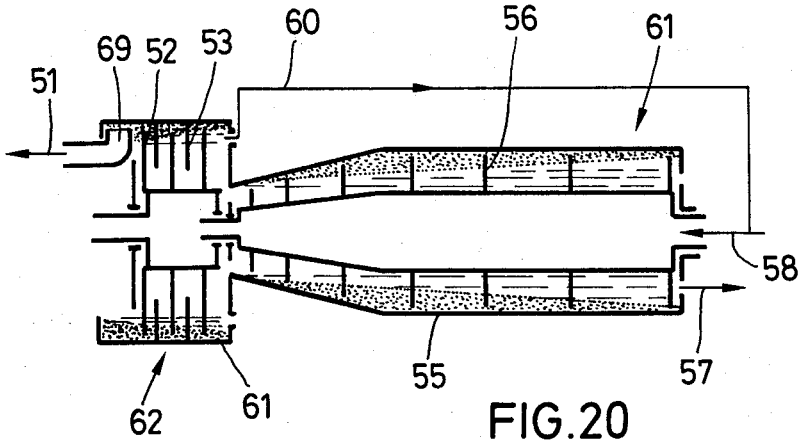

The apparatus of FIG. 20 includes a scraping device 69. In keeping with the invention, the shearing centrifuge 62 is greater in diameter than the cylindrical-conical decanter 61.

Figure 21:
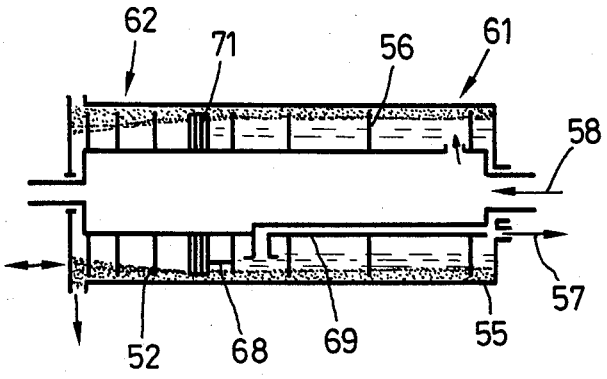

FIG. 21 shows a cylindrical decanter with a cylindrical shearing centrifuge. The separation between decanter and shearing centrifuge is provided by means of an immersion plate 71. The water which is freed in the shearing section flows through axial bores of the immersion plate 71 which is disposed radially further in the interior than the level of the clarification section. The sheared sludge becomes so solid that it can be discharged radially through openings of the drum. After the shearing, it is also possible to effect transport by means of a cone. The latter can be, along the lines of the invention, short and steep so that the centrifuge product can be eliminated through the axial channels of concurrent decanter 61.

Figure 22:
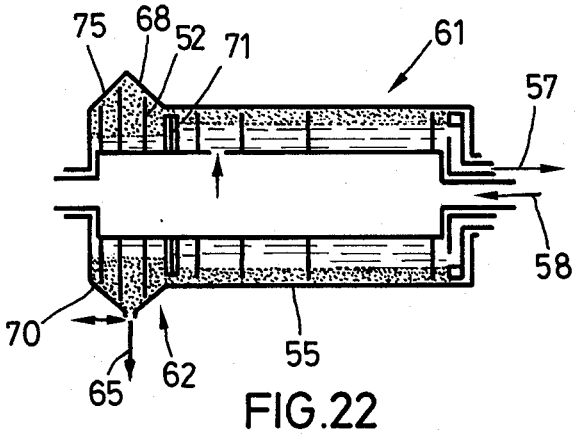

A shearing section which has a double conical section 68, 75 is shown in FIG. 22. The shearing section is kept very low in order to produce a high compression in the sludge. Also, in the case of this inventive embodiment, an immersion plate 71 is inserted between the cylinder section of the decanter and the shearing section.

The removal of the centrifuged product can be accomplished by means of a scraping plate. The ejection of the solid matter from the shearing section can proceed continuously by means of jets, or one cone is briefly displaced relative to the other by a small distance indicated at the arrow 65 so that an annular gap or passage results in order to carry the sludge in portions from the drum.

It will be evident that various modifications can be made to the described embodiments without departing from the scope of the present invention.

I claim as my invention:

1. An apparatus for dewatering sludge in the centrifugal field of a solid jacket centrifuge comprising:

a centerfuge drum, agitator elements situated within said centrifuge drum, said agitator elements including impelling means thereon, means for causing relative movement between some of said agitator elements and others of said agitator elements in a direction parallel to the rotational axis of said centrifuge, means for adjusting the amount of said relative movement between said agitator elements, means for adjusting the rotational speed of said agitator elements, and means for adjusting the angle of incidence of some of said agitator elements.

2. An apparatus according to claim 1 which includes a decanter section and a shearing cengtrifuge.

3. An apparatus according to claim 2 wherein said shearing centrifuge is in the form of a thrust shearing apparatus.

4. An apparatus according to claim 2 which includes a thrust rake having a controllable thrust frequency and thrust length.

5. An apparatus according to claim 2 wherein said decanter and shearing centrifuge are drivingly interconnected.

6. An apparatus according to claim 2 in which said shearing centrifuge is positioned axially behind said decanter and means for returning the centrifuged product from said shearing centrifuge into said decanter.

7. An apparatus according to claim 2 wherein said decanter and said shearing centrifuge are arranged axially behind one another and both have an essentially cylindrical configuration.

8. An apparatus according to claim 2 which includes a scraping device in said shearing centrifuge.

9. An apparatus according to claim 2 wherein said shearing centrifuge is in the form of a double cone, the two portions of said double cone being axially displaceable to form a discharge gap for the sheared sludge.

10. An apparatus according to claim 9 including means for controlling the relative displacement between said two portions.

11. An apparatus according to claim 1 wherein said drum includes adjoining cylindrical and conically shaped portions, and said agitator elements are located at the region of transition between said cylindrcial and conically shaped portions.

12. An apparatus according to claim 1 wherein said impelling means includes helical blades and said agitator elements are disposed between said helical blades.

13. An apparatus according to claim 12 wherein said helical blades have radial slots in their outer circumferential regions.

14. An apparatus according to claim 1 wherein said agitator elements extend radially inwardly from said centrifugal drum.

* * * * *